US006932022B1

(12) United States Patent
Keller et al.

(10) Patent No.: US 6,932,022 B1
(45) Date of Patent: Aug. 23, 2005

(54) SAVE A SKI

(76) Inventors: Raymond Joseph Keller, 1066 Cessna, Macedonia, OH (US) 44056; Deborah Ann Lytton, 14112 Rainbow Ave., Cleveland, OH (US) 44111

( * ) Notice: Subject to any disclaimer, the term of this patent is extended or adjusted under 35 U.S.C. 154(b) by 0 days.

(21) Appl. No.: 10/814,040

(22) Filed: Apr. 1, 2004

(51) Int. Cl.[7] ..... G09F 17/00; B63B 35/81
(52) U.S. Cl. ..... 116/209; 116/173; 116/215
(58) Field of Search ..... 441/68; 116/209, 116/173–175, 215, 28 R, 303, 26; 405/185, 405/186

(56) References Cited

U.S. PATENT DOCUMENTS 2,636,303 A * 4/1953 Feigley et al. ..... 43/17
2,930,343 A * 3/1960 Derrick ..... 116/215
3,232,265 A * 2/1966 Hurt ..... 116/28 R
3,643,902 A * 2/1972 Gualano ..... 248/539
3,714,923 A * 2/1973 Mariani ..... 116/209
4,026,236 A * 5/1977 Robbins ..... 116/209
4,599,965 A * 7/1986 Johnson ..... 116/209
4,835,523 A * 5/1989 Pruett ..... 340/571
5,000,482 A * 3/1991 Cimino ..... 280/809
5,514,016 A * 5/1996 Larson ..... 441/6
6,199,503 B1 * 3/2001 Midgett ..... 116/28 R
6,250,248 B1 * 6/2001 Patera ..... 116/209
6,573,834 B1 * 6/2003 Grimani et al. ..... 340/573.1

* cited by examiner

*Primary Examiner*—Chris Fulton
*Assistant Examiner*—R A Smith

(57) ABSTRACT

A visual device placed on a water ski that enables easy detection of the ski in various water and weather conditions. A reflective red flag attaches to a flexible spring that is attached to a rotator. A second spring attached to the rotator is connected to a counterweight to balance the flag. The rotator is rotatably coupled to a bracket that attaches to a water ski. In use, the device bends out of the way as to not interfere with the performance of the water ski. When the ski is not in motion, gravity causes the counterweight to move the flag to an upright position to allow visual detection of the ski.

3 Claims, 3 Drawing Sheets

SAVE A SKI

BACKGROUND

This invention relates in general to a visual device for locating water skis that have become separated from a skier.

Water skiing is a sport in which a person standing on one or more water skis is pulled across a surface of a body of water by a boat. People learning how to water-ski often learn on two skis. However, as a skier develops more experience and skill, the skier may advance to skiing on one ski.

When a skier transitions from two skis to one, some skiers start by skiing on two skis, and once balanced, drop one ski off. The dropped ski floats in the water until after the skier finishes skiing, when the boat returns to pick it up.

Unfortunately, the boat may go some distance from the dropped ski before returning to look for it. The wind and currents may cause the ski to drift, and choppy waters conceal the ski from view. Skis are easily lost when the skiers cannot remember where the ski was dropped, or when choppy water or the dim light of dusk hides the ski.

Loosing a ski is expensive to the skier when the skier replaces it. Further, lost skis can cause costly damage to boats that run over them, unaware that they are in the water.

SUMMARY

The present invention relates to a visual device attachable to a water ski for locating the water ski in the water, the device comprising a bracket adapted for attachment to a water ski; a rotator rotatably coupled to the bracket for 360 degree rotation relative to the bracket, the rotator having a periphery with a top hole and a bottom hole, the bottom hole being located approximately 180 degrees from the top hole on the periphery; a top spring having an end affixed in the top hole and an opposite end affixed to a flag, wherein the top spring is adapted to flex, and a bottom spring having an end affixed in the bottom hole and an opposite end affixed to a counterweight, wherein the bottom spring is adapted to flex.

The counterweight has a weight greater than that of the top spring and the flag so that the weight of the counterweight causes the flag to rotate to a position substantially upright when the water ski is substantially not moving to allow visual detection of the flag and for locating the water ski in the water.

DETAILED DESCRIPTION

Figure 1:
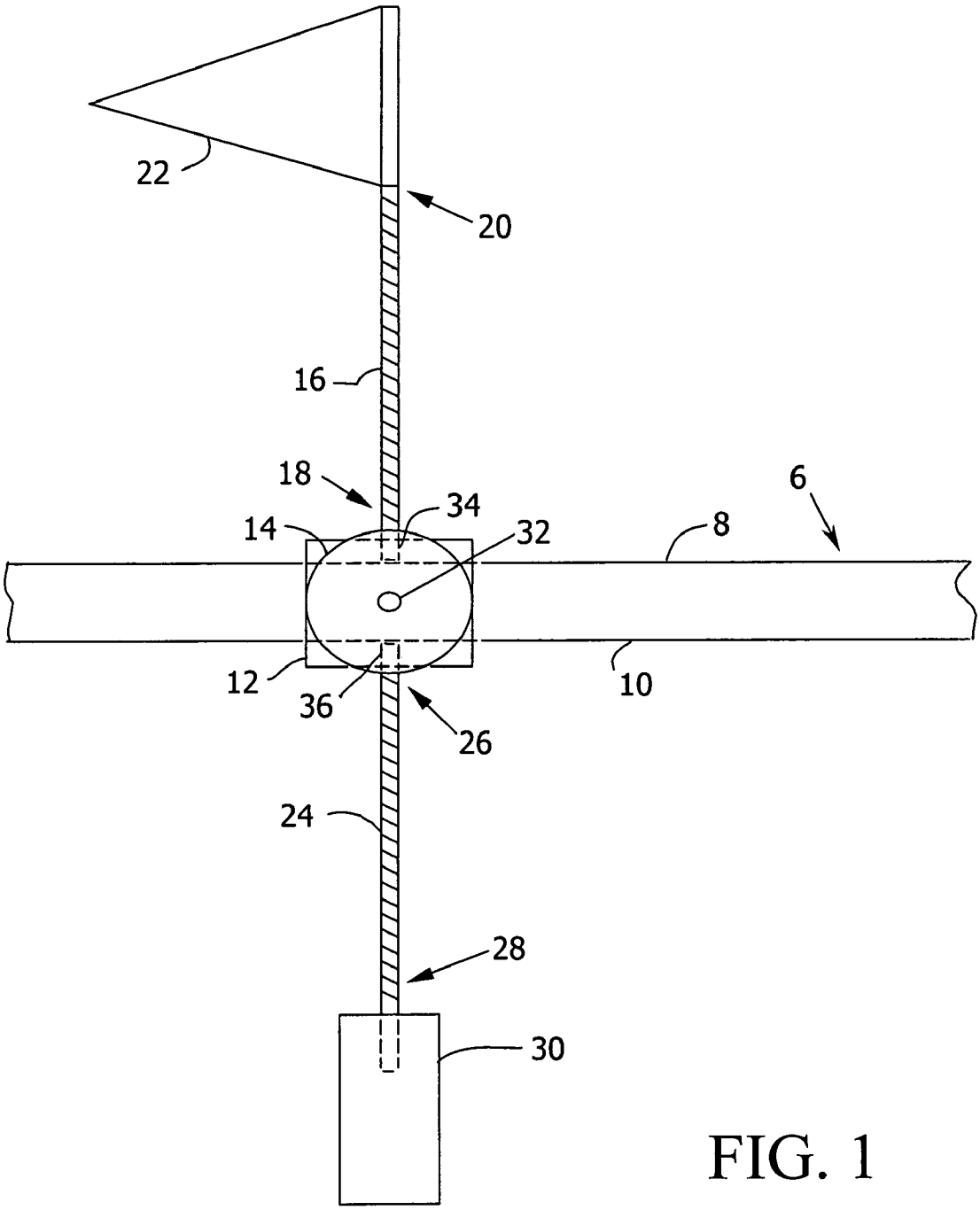
FIG. 1 is a partial side elevational view of the present invention affixed to a ski.
Figure 2:
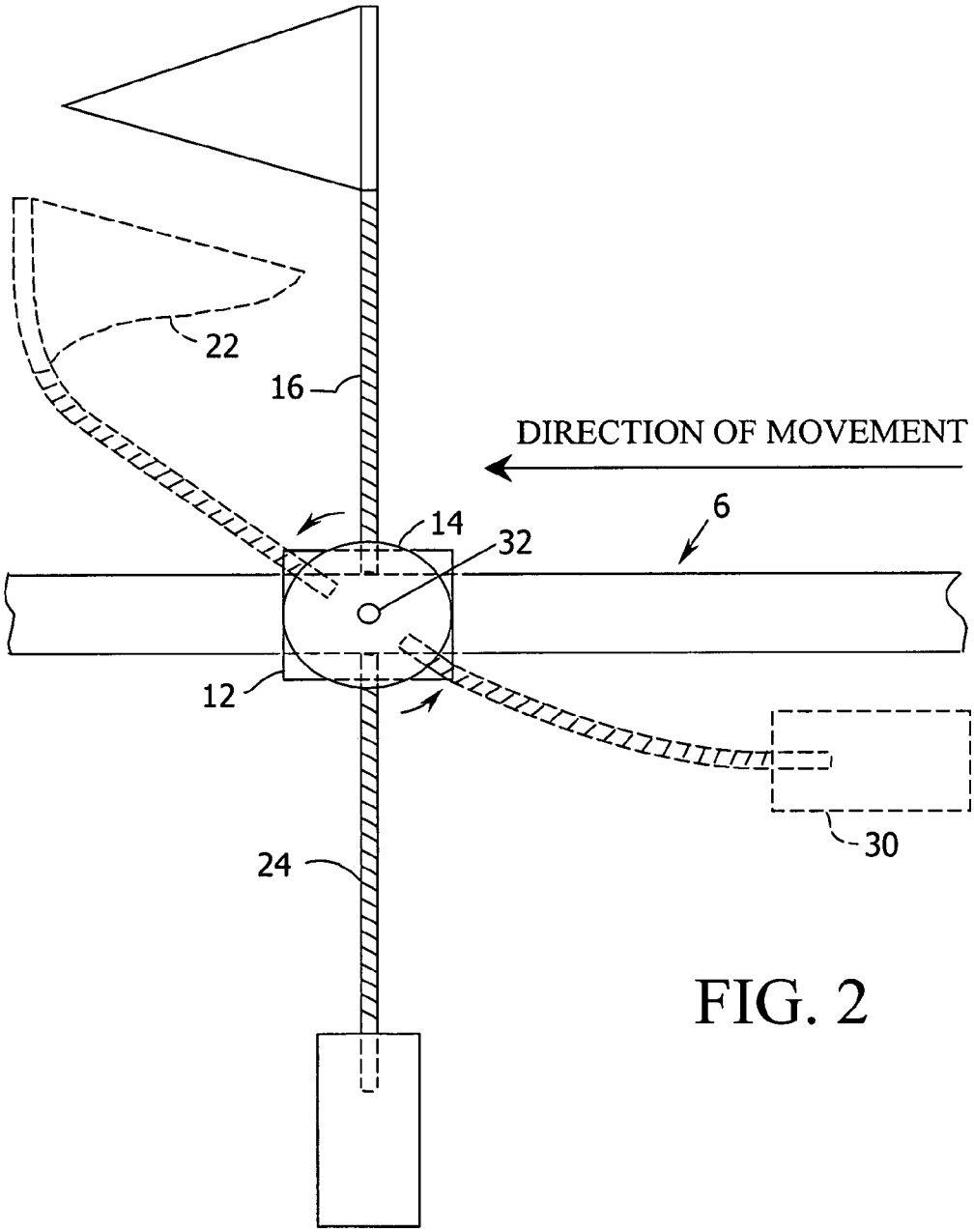
FIG. 2 is a partial side elevational view of the present invention affixed to a ski, shown as the ski is moving through the water.
Figure 3:
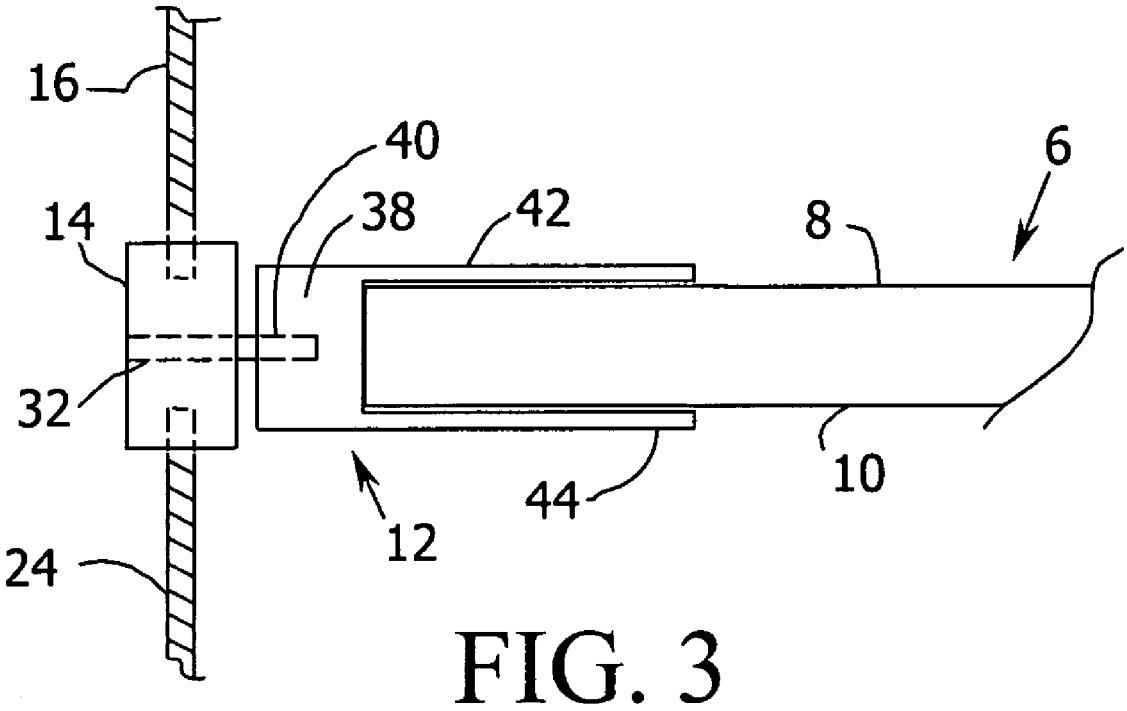
FIG. 3 is a partial rear elevational view of the present invention affixed to a ski.

Referring now to FIGS. 1–3, the visual device of the present invention is shown installed on a water ski 6, having a ski top 8 and a ski bottom 10. A bracket 12 is attached to the water ski 6. A rotator 14 is rotatably coupled to the bracket 12, positioned and adapted to provide 360-degree rotation relative to the bracket. A top spring 16 has a top spring first end 18 affixed to the rotator 14, and a top spring second end 20 affixed to a flag 22. A bottom spring 24, has a bottom spring first end 26 affixed to the rotator 14, and a bottom spring second end 28 affixed to a counterweight 30.

In one embodiment, the weight of the counterweight 30 is between 56 and 198 grams (2 and 7 ounces). In this embodiment, the weight of the counterweight 30 exceeds the combined weight of the top spring 16 and the flag 22. The counterweight 30 may be shaped as a cylinder, approximately 5 cm (2 inches) in length and 1.3 cm (0.5 inch) in diameter, and made of steel. In one embodiment, the counterweight further comprises a threaded hole, adapted to hold the bottom spring second end 28. In this embodiment, the counterweight 30 has a bevel, tapering to the hole. The beveled shape offers less resistance when the counterweight 30 is moving through the water.

In one embodiment, the rotator 14 is made of polyethylene, is cylindrically shaped, and adapted to rotate about its cylindrical axis. A rotator stud 32 is affixed to the bracket 12 and is positioned coaxially with the cylindrical axis of the rotator 14, adapted to allow the rotator 14 to rotate 360 degrees around the rotator stud 32. In this embodiment, the rotator 14 further includes a top hole 34 positioned on the peripheral surface of the rotator 14. Top hole 34 is adapted to hold the top spring first end 18. In one embodiment, the top hole 34 is threaded such that the top spring first end 18 is screwed into top hole 34. In this embodiment, the rotator 14 is approximately 3.8 cm (1.5 inch) in diameter and 1.3 cm (0.5 inch) thick. In addition, the rotator stud 32 may be a threaded bolt such as a common 0.62 cm (0.25 inch) diameter bolt, approximately 2.5 cm (1.0 inch) in length. Such bolts are often referred to as ¼-20 bolts when the threaded portion includes 20 threads per inch of length.

The rotator 14 further includes a bottom hole 36 positioned on the peripheral surface of the rotator 14 approximately 180 degrees from the top hole 34. Bottom hole 36 is adapted to hold the bottom spring first end 26. In one embodiment, the bottom hole 36 is threaded such that the bottom spring first end 26 is screwed into bottom hole 36.

The bracket 12 is adapted to be affixed to the ski 6. In one embodiment, the bracket 12 is made of polyethylene or polypropylene and comprises a vertical section 38 that supports the rotator stud 32. In this embodiment, the vertical section 38 includes a threaded hole 40 adapted to accept the rotator stud 32. Extending from the vertical section 38 is a top tab 42 and a bottom tab 44. The top tab 42 and bottom tab 44 are spaced apart enough for the ski 6 to fit between. In one embodiment, the top tab 42 is removably secured to the ski top 8 by a VELCRO® brand or other hook and loop fastener. Similarly, the bottom tab 44 is removably secured to the ski bottom 10 by a VELCRO® or other brand hook and loop fastener. In this way, the bracket 12 can be removed from the ski 6 by pulling the top tab 42 and bottom tab 44 apart enough to disengage the VELCRO® or other brand hook and loop fasteners and remove the ski 6.

To facilitate disengagement from the hook and loop fasteners, the top tab 42 and bottom tab 44 may be approximately 8 cm (3 inch) in length. In one embodiment, the top tab 42 and bottom tab 44 are approximately 2.5 cm (1.0 inch) wide and 0.5 cm (0.2 inch) thick. In this embodiment, the vertical section 38 measures approximately 2.5 cm (1.0 inch) from the top tab 42 to the bottom tab 44. Further, the vertical section may be approximately 3.8 cm (1.5 inch) wide and 1.3 cm (0.5 inch) thick.

In one embodiment, the counterweight 30, bottom spring 24, rotator 14, top spring 16, and flag 22 operate together. When the bracket is installed on a ski 6 and the ski 6 is floating in water, gravity causes the counterweight 30 to move to a straightened position below the ski 6 as shown in FIG. 1. When the ski 6 is in motion as indicated in FIG. 2, the flow of water will cause the counterweight 30 to move. Movement of the counterweight 30 causes the rotator 14 to rotate about the rotator stud 32, causing the top spring 16 and flag 22 to move opposite of the counterweight 30. Thus, when the ski 6 stops moving, the flag 22 will always end up in an upward position regardless of whether the ski top 8 or ski bottom 10 is facing up.

When a water-skier is using the ski 6, the ski 6 is pulled through the water. When the ski 6 is in motion, water flow causes the counterweight 30 and the bottom spring 24 to move to a flexed position as shown in FIG. 2. When the counterweight 30 and bottom spring 24 move to the flexed position, the rotator 14 turns, causing the top spring 16 and flag 22 to rotate forward as shown in FIG. 2. The top spring 16 provides flexibility while the ski 6 moves through the water.

In one embodiment, the flag 22 is brightly colored and reflective, such as a red or silver color, to make the ski 6 easier to locate. The flag may be triangular in shape, approximately 5 cm (2 inches) wide and 10 cm (4 inches) long. In this embodiment, the flag 22 is glued to the top spring 16.

In one embodiment, the top spring 16 and the bottom spring 24 are made from grade-304 stainless steel. The top spring 16 and the bottom spring 24 are a suitable size, such as 0.5 cm (0.2 inch) diameter spring stock. In this embodiment, the top spring 16 is approximately 18 to 20 cm (7 to 8 inch) in length, and the bottom spring 24 is approximately 15 to 18 cm (6 to 7 inch) in length.

Although the principles, alternate embodiments, and operation of the present inventions have been described in detail herein, the visual device is not to be construed as being limited to the particular illustrative forms disclosed. It will thus become apparent to those skilled in the art that various modifications of the embodiments herein can be made without departing from the spirit or scope of the invention as defined by the following claims.

What is claimed is:

1. A visual device attachable to a water ski for locating the water ski in the water, the device comprising:

a bracket adapted for attachment to a water ski;

a rotator rotatably coupled to the bracket for 360 degree rotation relative to the bracket, the rotator having a periphery with a top hole and a bottom hole, the bottom hole being located approximately 180 degrees from the top hole on the periphery;

a top spring having an end affixed in the top hole and an opposite end affixed to a flag, wherein the top spring is adapted to flex; and a bottom spring having an end affixed in the bottom hole and an opposite end affixed to a counterweight, wherein the bottom spring is adapted to flex;

wherein the counterweight has a weight greater than that of the top spring and the flag so that the weight of the counterweight causes the flag to rotate to a position substantially upright when the water ski is substantially not moving to allow visual detection of the flag and for locating the water ski in the water.

2. The visual device of claim 1 wherein the flag is triangular in shape and made of a brightly colored and reflective material.

3. The visual device of claim 1 wherein the top spring is approximately 18 to 20 cm (7 to 8 inches) in length.

* * * * *